United States Patent [19]

Röhrscheid

[11] 4,204,797

[45] May 27, 1980

[54] WARP BEAM ELEVATING AND TRANSPORT CARRIAGE FOR TWIN WARP BEAMS

[75] Inventor: Karl Röhrscheid, Willich, Fed. Rep. of Germany

[73] Assignee: System Schultheis GmbH & Co., Fulda, Fed. Rep. of Germany

[21] Appl. No.: 907,332

[22] Filed: May 18, 1978

[30] Foreign Application Priority Data

May 18, 1977 [DE] Fed. Rep. of Germany ..... 2722528

[51] Int. Cl.[2] ..... B62B 3/04

[52] U.S. Cl. ..... 414/458; 414/911

[58] Field of Search ..... 414/458, 680, 684, 911; 242/118.41, 118.5; 28/201, 208; 294/87 R, 19 R

[56] References Cited

U.S. PATENT DOCUMENTS

| | | | |
|---|---|---|---|
| 3,433,499 | 3/1969 | Meierhofer | 28/201 X |
| 3,638,815 | 2/1972 | Fincher . | |
| 4,148,406 | 4/1979 | Kutzschebauch | 414/458 |

FOREIGN PATENT DOCUMENTS

| | | | |
|---|---|---|---|
| 823585 | 11/1959 | United Kingdom | 242/118.41 |

*Primary Examiner*—Stephen G. Kunin
*Assistant Examiner*—Terrance L. Siemens
*Attorney, Agent, or Firm*—Schwartz, Jeffery, Schwaab, Mack, Blumenthal & Koch

[57] ABSTRACT

A warp beam transport and elevating carriage for twin warp beams is provided having a longitudinally extending shaft capable of rotation about its longitudinal axis, a plurality of gripper arms fixed to the shaft and extending downwardly to securely support twin warp beams at each end, and twin warp beams mounted for transport and elevation without danger of displacement or dislodgement. Two rods connected by a link joint with a connecting plug on one end of one rod are inserted into a central tube mounting the twin warp beams. The connecting plug is inserted into an aperture in the adjacent ends of each central tube of the twin warp beams and provides a secure gripping point for the central gripper arm.

5 Claims, 4 Drawing Figures

FIG. 1
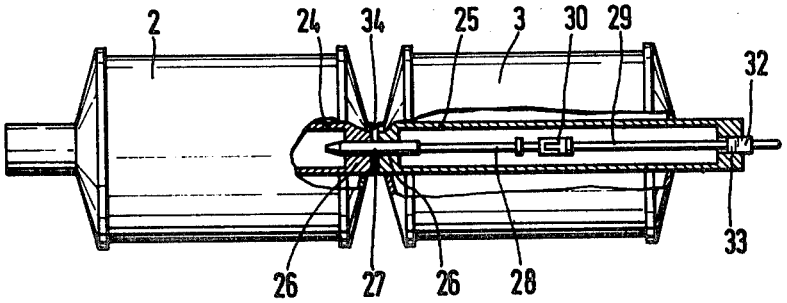
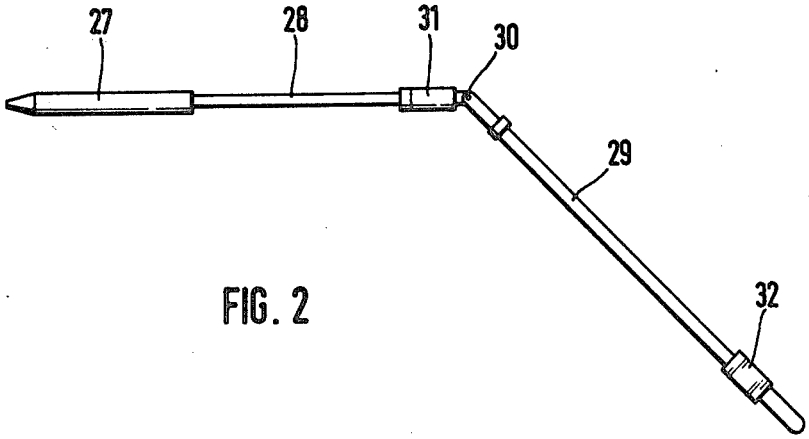
FIG. 2

WARP BEAM ELEVATING AND TRANSPORT CARRIAGE FOR TWIN WARP BEAMS

BACKGROUND OF THE INVENTION

1. Field of the Invention

This invention relates to a warp beam elevating and transport carriage for twin warp beams with gripper arms intended to engage the ends of the warp beams, the gripper arms being mounted on a shaft arranged in longitudinal direction of the carriage, parallel to and with a certain distance from it. The gripper arms are lifted by rotating the shaft.

2. Description of the Prior Art

In Known carriages for twin warp beams the projecting gripper arms are connected with a shaft extending in longitudinal direction of the carriage and intended for rotation by a force and engage the ends of the twin warp beam. An intermediate gripper arm is in the same manner connected for rotating with the shaft and engages the center of the twin warp beam, i.e. the oppositely adjacent ends of the two warp beams disposed opposite each other.

The above mentioned carriages are not particularly suitable for the transport of twin warp beams, because the support in the center of the twin warp beams is only very small. Disadvantages can result from the smallness of this center portion. The twin warp beam may loose its support, even when minor shocks occur during transport.

To avoid these disadvantages, U.S. Pat. No. 4,148,406 provides that the gripper arms engaging the external ends of the twin warp beams are arranged to bias the warp beams in axial direction against the internal ends of the twin warp beams, for which purpose the gripper arms acting on the ends of the warp beams are suspended pendulum-like on the shaft, the pendulum axis of the gripper arms being inclined to the direction of the axis of the shaft.

The arrangement according to U.S. Pat. No. 4,148,406 has been working very well. However, a disadvantage consists in that the central gripper arm must be of a very strong and sturdy design, which requires space, in axial direction and which is a problem that cannot easily be solved under restricted room and space conditions.

OBJECT OF THE INVENTION

The invention, therefore, has as its major object to eliminate these disadvantages and to provide an arrangement with which a space saving, narrow design of the center gripper arm is possible without thereby impairing the safety of the support of the twin warp beam.

SUMMARY OF THE INVENTION

According to the invention, a warp beam elevating and transport carriage for twin warp beams each having a central tube and ends, comprises an essentially horizontal rotatable shaft and gripper arms mounted to the shaft and adapted to be lifted by rotation of the shaft and to engage the ends of the warp beams, which, when engaged, extend coaxially aligned parallel to the shaft at a distance therefrom, and further comprises a connecting plug bridging the gap between the adjacent ends of the central tubes of the twin warp beam and being guided in said adjacent ends and connected to an axially movable element disposed in one of the central tubes and projecting from this central tube at its other end, wherein one of the gripper arms engages the connecting plug of the central tubes in the gap between said adjacent ends thereof.

With the aid of this structure, a removable rigid connection can be produced between the two warp beams bridging the gap between the two central tubes and uniting the central tubes to a rigid beam, to a certain extent whereby the central gripper arm has to sustain a smaller load, so that it can be designed with a space saving dimensioning with a very small gap between the two central tubes.

The axially movable element preferably consists of rod means adapted to be inserted said one of the central tubes from said other end and carrying the connecting plug at the front point.

The rod means may comprise two rods separated by a link joint blockable when the rods are in their straightly aligned position.

The separation by a link offers the advantage that the rods together with the connecting plug can still be introduced into the central tube when there is only little handling space available, which may be the case between two narrowly adjacent machines.

A safety device may be provided preventing a relative rotation of the axially movable element and the central tube.

The safety device may comprise a polygonal section on one of the rods and a polygonal opening corresponding to the shape and the size of the polygonal section in the end of the central tube and adapted to receive the said polygonal section.

The polygonal opening should allow the axial passage of the connecting plug and the link joint.

The gap between the adjacent ends of the central tubes is preferably not larger than approximately 6 mm.

BRIEF DESCRIPTION OF THE DRAWINGS

One preferred embodiment of the invention will now be described in detail with reference to the accompanying drawing, in which FIG. 1 is a view of a twin warp beam, partly in section;

FIG. 2 shows the rods together with the connecting plug;

The illustration is limited to those parts which are necessary for the understanding of the invention.

DETAILED DESCRIPTION OF THE PREFERRED EMBODIMENT

Figure 3:
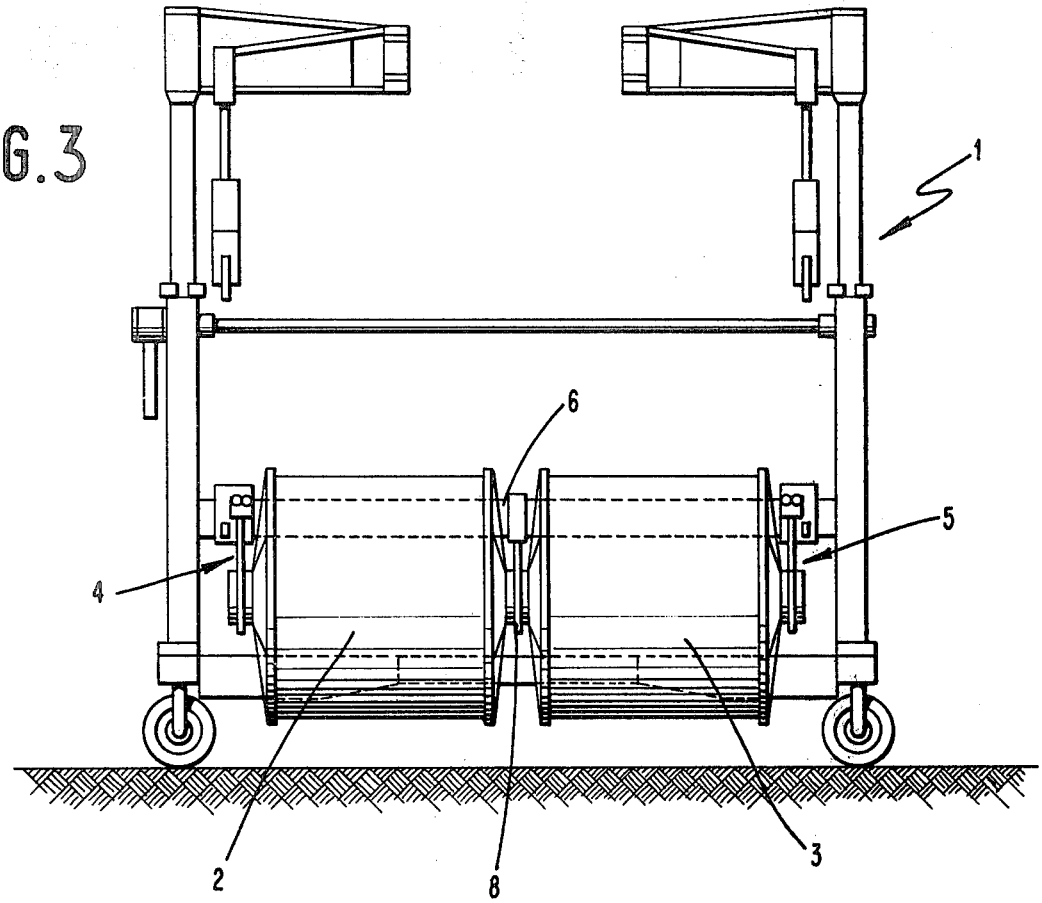
FIG. 3 is a view of the warp beam elevating and transport carriage.

The twin warp beam consists of the two warp beams 2 and 3. It is supported at its external ends by gripper arms 4 and 5, more clearly seen in FIG. 3, are mounted on a shaft 6 rotatably supported on the carriage 1 and extending in longitudinal direction parallel to the axis of the warp beams 2, 3 just at the side of the warp beams 2, 3. When the shaft 6 is rotated, the gripper arms also rotate and lift the warp beams 2, 3 from the ground. The gripper arms are so designed and arranged (see the U.S. Pat. No. 4,148,406), that the gripper arms effect a bias in axial direction on the outer ends of the central tubes 24, 25 of the twin warp beam 2, 3 directed towards the central gap between the twin warp beams 2, 3 when swinging upwards or when elevating the twin warp beams 2, 3, respectively.

A connecting plug 27 passes through the adjacent central ends 26 of the warp beams 2, 3. The plug 27 is fastened to a handling device consisting of the rods 28 and 29 which are disposed in the central tube 25. The rods 28 and 29 are connected with each other by means of a link joint 30. The articulating connection of the two rods 28 and 29 can be blocked by means of sleeve 31, when the two rods are in their axially aligned position. To this effect the sleeve 31 is so moved in axial direction of the axially aligned rods that the link joint 30 is covered by the sleeve. The link joint connection is set free for articulation by a movement of the sleeve 31 in reverse direction.

Figure 4:
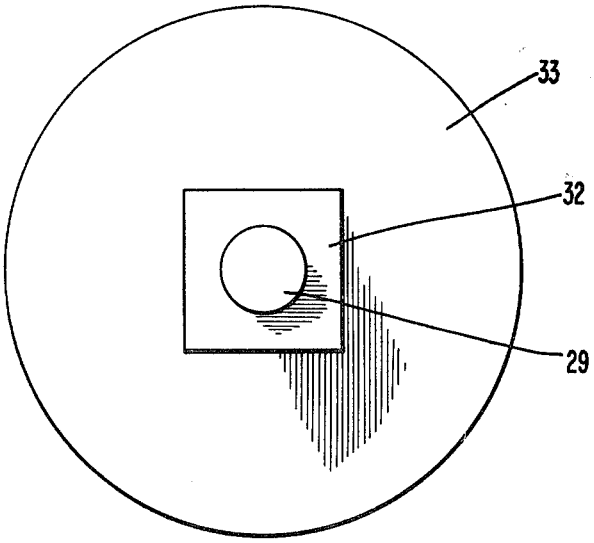
FIG. 4 is an end view of the safety device of the present invention.

The end of the rod 29 projecting from the central tube 25 serves as handle for actuation of the rods. A polygonal section 32, which is of square cross-section in the embodiment shown in FIG. 4, is provided at the projecting end of the rod 29. Polygonal section 32 fits into a opening of corresponding shape and size going through the end piece 33 of the central tube 25.

The rods 28, 29 are pushed into the central tube 25 from the side of the end piece 33. The rods may be articulated by means of the link joint 30, as shown in FIG. 2 of the drawing, when narrow space conditions make this necessary. The rods are brought into their straight, axially aligned position when the sleeve 31 has almost reached the end piece 33. Then the sleeve is slid over the link joint 30. The straightly aligned rods 28, 39 are then further pushed inwards. During this action the polygonal section 32 enters fittingly into the opening of the end piece 33, as can be seen in FIG. 1.

The central gripper arm 6, has a thickness which is determined by the gap width, which is not larger than 6 mm. It enters the narrow gap 34 remaining between the ends of the central tubes and engages plug 27.

What is claimed is:

1. A warp beam elevating and transport carriage for twin warp beams each having a central tube and ends, the carriage comprising an essentially horizontal rotatable shaft and gripper arms mounted to the shaft and adapted to be lifted by rotation of the shaft and to engage the ends of the warp beams, which, when engaged, extend coaxially aligned parallel to the shaft at a distance therefrom, the carriage further comprising a connecting plug bridging the gap between the adjacent ends of the central tubes of the twin warp beam and being guided in said adjacent ends and connected to an axially movable element disposed in one of the central tubes and projecting from this central tube at its other end, wherein one of the gripper arms engages the connecting plug of the central tubes in the gap between said adjacent ends thereof, said axially movable element comprises rod means, insertable into one of said central tubes through one of said other ends of said warp beams, for carrying said connecting plug, wherein the rod means comprises two rods separated by a link joint, said rod means further including means for blocking said link joint when the rods are in their straightly aligned position.

2. The warp beam elevating and transport carriage according to claim 1 wherein a safety device is provided preventing a relative rotation of the axially movable element and the central tube.

3. The warp beam elevating and transport carriage according to claim 1, wherein a safety device is provided preventing a relative rotation of the rods and the central tube, the safety device comprising a polygonal section on one of the rods and a polygonal opening corresponding to the shape and the size of the polygonal section in the end of the central tube and adapted to receive the said polygonal section.

4. The warp beam elevating and transport carriage according to claim 3, wherein the polygonal opening allows the axial passage of the connecting plug and the link joint.

5. The warp beam elevating and transport carriage according to claim 1, wherein the width of the gap is not larger than approximately 6 mm.

* * * * *